United States Patent [19]

Kitchens

[11] Patent Number: 4,930,762

[45] Date of Patent: Jun. 5, 1990

[54] PORTABLE ENVELOPE FEEDER

[76] Inventor: Wesley P. Kitchens, 13419 Pumice, Norwalk, Calif. 90650

[21] Appl. No.: 207,647

[22] Filed: Jun. 16, 1988

[51] Int. Cl.[5] ..... B65H 5/08; B65H 1/18

[52] U.S. Cl. ..... 271/11; 271/152; 271/171; 271/166; 400/625

[58] Field of Search ..... 271/157, 152, 153, 154, 271/155, 160, 162, 171, 145, 2, 147; 400/624, 625; 414/795.8, 796.7, 797, DIG. 900, 907; 209/534; 235/379

[56] References Cited

U.S. PATENT DOCUMENTS

| | | | |
|---|---|---|---|
| 699,975 | 5/1902 | Reynolds | 271/2 X |
| 1,329,108 | 1/1920 | Burkley | 271/2 |
| 1,584,789 | 5/1926 | Megathlin | 271/162 |
| 1,724,199 | 8/1929 | Hoag | 271/2 |
| 2,076,186 | 4/1937 | Reynolds et al. | 271/157 X |
| 2,130,101 | 9/1938 | Ritzerfeld . | |
| 2,138,343 | 11/1938 | Durup | 271/2 X |
| 2,444,580 | 7/1948 | Pratt et al. | 271/171 |
| 2,550,160 | 4/1951 | Monk | 271/171 |
| 2,631,850 | 3/1953 | Smith | 271/162 |
| 2,651,420 | 9/1953 | Wray et al. | 271/145 X |
| 3,022,997 | 2/1962 | Pendley | 271/171 X |
| 3,146,902 | 9/1964 | Voelker | 271/2 X |
| 3,893,664 | 7/1975 | Thomsen | 271/100 |
| 4,004,797 | 1/1977 | Schoppee | 271/162 X |
| 4,067,566 | 1/1978 | Williams | 271/2 |
| 4,365,700 | 12/1982 | Arimoto et al. | 235/379 X |
| 4,431,323 | 2/1984 | Kulow | 400/625 |
| 4,436,469 | 3/1984 | Kelly | 271/171 X |
| 4,504,053 | 3/1985 | Shiozawa | 271/157 X |
| 4,625,641 | 12/1986 | Jagosz et al. | 101/240 |
| 4,784,274 | 11/1988 | Mori et al. | 209/534 |

FOREIGN PATENT DOCUMENTS

| | | | |
|---|---|---|---|
| 1098009 | 1/1961 | Fed. Rep. of Germany | 271/157 |
| 308285 | 9/1955 | Switzerland | 271/171 |
| 1002111 | 8/1965 | United Kingdom | 271/157 |

OTHER PUBLICATIONS

IBM Disclosure Bulletin, vol. 19, No. 7, Dec., 1976, Sheet Feeding Apparatus, Fallon and Kollar, pp. 2440–2441.

*Primary Examiner*—Skaggs, H. Grant
*Attorney, Agent, or Firm*—Howard A. Kenyon

[57] ABSTRACT

A portable envelope feeder that is not dedicated to a specific offset printer but can be used with multiple offset printers is described. The portable feeding apparatus is clamped to the feed elevator in order to supply an envelope stack to the offset printer. The envelope feeder has the capability of tilting back to facilitate loading of the envelope stack. A sliding weight in one of the vertical members holds the envelopes in place and also counters the moment created when the sucker foot on the printing press grips the individual envelope and pulls the envelope into the offset press. A height control bar insures that the envelope stack is always at the correct position for the sucker foot to grip and envelope. By utilizing a different size plate where the envelope stack rests and making a slight adjustment on the base plate, the present invention can feed a plurality of envelope sizes.

1 Claim, 2 Drawing Sheets

PORTABLE ENVELOPE FEEDER

BACKGROUND OF THE INVENTION

1. Field of the Invention

The invention pertains to a portable envelope feeder used with an offset printing press. More specifically, this invention pertains to a simple feeder that can be used with a multiple of offset printers.

2. Description of the Prior Art

The offset printer is an inexpensive and desirable way to print a substantial number of items such as sheet stock and envelopes. However, most offset printers are designed for sheet stock with an inefficient and slow method of printing envelopes. Usually it resorts to being a hand fed operation. There are, however, offset printers that are solely dedicated to printing envelopes that contain automatic and complicated envelope feeding mechanisms permanently attached to the printer. For the small printing shop the cost of having an offset printer sitting idle most of the time and used only to print envelops cannot be tolerated. In order to prevent either a slow hand fed operation or a dedicated printer for solely envelopes, the present invention provides a simple portable envelope feeder that can be set up in a matter of minutes and feed a stack of envelopes to the offset printer as quickly as sheet stock can be fed. The feeder can hold an entire box (500 envelops) or any portion thereof and provide an efficient and reliable feeder for envelopes of a plurality of standard sizes. It is also estimated that the present envelope feeder can be used on 12 different offset printers presently in use.

There are a number of envelope feeders in use today but most have the drawback of being dedicated to a specific offset printer. There is, however, an envelope feeder that is designed to feed multiple stacks into an offset printer. This feeder is described in U.S. Pat. No. 4,625,641 to Jagosy et al. The structure is considerably different from the present invention, however, as only one stack at a time is fed by the present invention into the offset printer. The mechanism in Jagosy et al that is used to change to a different size envelope is also completely different from the one described in the present invention. While it appears that the feeding system described by Jagosy et al will fit on some type of offset printers of which he designates at 10, he is completely silent on what type or model of printer that can utilize his feeding mechanism.

Another apparatus for feeding envelopes is described in U.S. Pat. No. 2,130,101 by Ritzerfeld. This device does not use any suction device as in the present invention but uses a flat tang like plate to pull the envelops of the bottom of the stack.

Still another envelope feeder apparatus is U.S. Pat. No. 4,431,323 to Kulow. This invention relates to a system for serially feeding envelops to a printing machine such as a typewriter which is unlike the feeder of the present invention.

What is needed is an inexpensive, simple portable feeder that can be adjusted to fit a substantial number of offset printing presses in addition to accepting a plurality of envelope sizes. In this manner a small printing shop can have one offset printer that can normally print flat stock and in minutes convert the same offset printer to a high speed envelope printer.

SUMMARY OF THE INVENTION

It is the object of the present invention to provide a portable envelope feeder that can be quickly attached to an offset printer.

It is another object of this invention to be able to quickly adjust by substituting plates the capability of printing a plurality of envelope sizes.

It is still another object of this invention to provide a portable envelope feeder that can be attached to a substantial number of small offset printers.

It is yet another object of this invention to provide a portable envelope feeder that tilts to a position that will alow a box of envelopes to be loaded quickly and efficiently.

Briefly, in accordance with this invention, there is provided a portable envelope feeder that will fit on a substantlal number of different offset printing machines. In addition, the present lnvention will accommodate, with a plate substitution and a slight adjustment, a plurality of envelope sizes. The present invention tilts back for easy loading and contains a sliding weight to provide a friction force as well as a counter moment to the gripping means which is a sucker foot. The present invention can be attached and detached from the elevator platform of offset printers in a matter of minutes. In addition, this envelope feeder is strong, has high reliability and is very economical.

Other objects and advantages of the invention will become apparent upon reading the following detailed description and upon reference to the drawings.

While the invention will be described in connect1on with the preferred embodiment, it will be understood that it is not intended to limit the invention to those embodiments . On the contrary, it is intended to cover all alternatives, modifications and equivalents that may be included within the spirit and scope of the invention as described by the appended Claims.

DETAILED DESCRIPTION OF THE INVENTION

Figure 1:
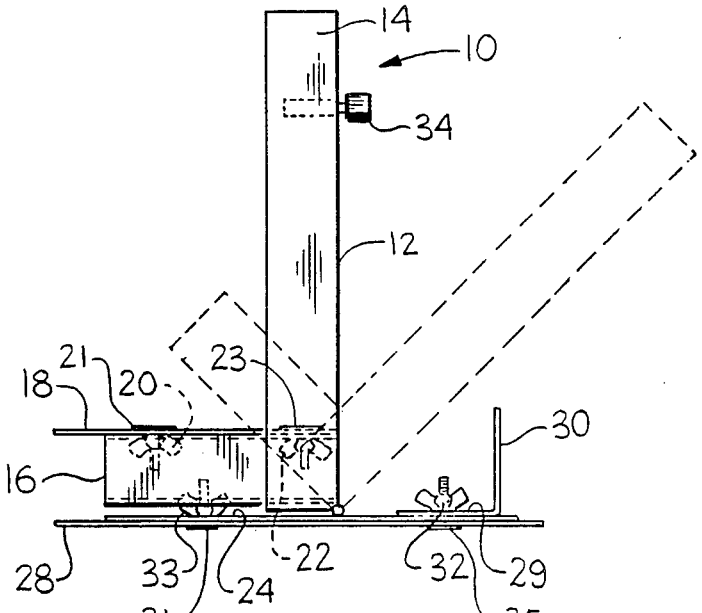
FIG. 1 is a side exposed view of the portable envelope feeder showing how part of the frame can tilt back for easy loading.

Referring now to FIG. 1, there is shown a portable envelope feeder generally shown as 10 having a first vertical rectangular member 14 and a second vertical rectangular member 12. Second vertical rectangular member 12 and first vertical rectangular member 14 are attached at one corner preferably by welding or some other means such that vertical rectangular members 12 and 14 are perpendicular to each other. Second vertical rectangular member 12 is also attached preferably by welding or some other means to one end of a rectangular base 16 which is also perpendicular to vertical rectangular members 12 and 14. Rectangular base 16 is a rectangular member, open at each end, having a top, two sides and a bottom with the bottom cut away in the center to provide access to the bottom side of the base top. On top of rectangular base 16 there is placed a first rectangular plate 18 that is attached to rectangular base 16 by two thumb screws 20 and 22 which are attached to bolts 21 and 23 placed through symmetrical holes along the centerline of both rectangular base 16 and first rectangular plate 18.

Placed directly below rectangular base 16 is a second rectangular plate 24 which is also an attachment for a hinge 26 that is attached to the bottom end of second vertical rectangular member 12. Directly below the second rectangular plate 24 is a rectangular base plate 28 that extends beyond the second rectangular plate 24 and rectangular base 16 un one end and beyond the second rectangular plate 24 on the other end. The rectangular base plate 28 contains two symmetrical slots 40 and 42 along the centerline of the rectangular base plate 28. The second rectangular plate 24 has two symmetrical holes placed along the centerline of second rectangular plate 24. The second rectangular plate is extended aft of hinge 26 to provide stability.

On the aft portion of the rectangular base plate 28 there is a stop composed of a member 29 that is adjacent to second rectangular plate 24 and another member 30 perpendicular to the first member and joined at the corner preferably by welding. This stop is secured to the rectangular base plate 28 and second rectangular plate 24 by a thumb screw 33 attached to bolt 35 placed through the slot in rectangular base plate 28 and the hole in the second rectangular plate 24.

It it also noted that rectangular base plate 28 is held in place by thumb screw 33 attached to bolt 35 and thumb screw 32 attached to bolt 31 placed through the slot in rectangular base plate 28 and the hole in the second rectangular plate 24. All of the above members form the envelope feeder frame which is made from sheet metal of sufficient gauge to provide adequate strength. As seen in FIG. 1 by the dotted line drawing, the vertical rectangular members 12 and 14 along with the rectangular base 16 and first vertical plate 18 can be tilted back to rest against stop member 30. In this manner an entire box of envelopes can be loaded into the portable envelope feeder.

Figure 2:
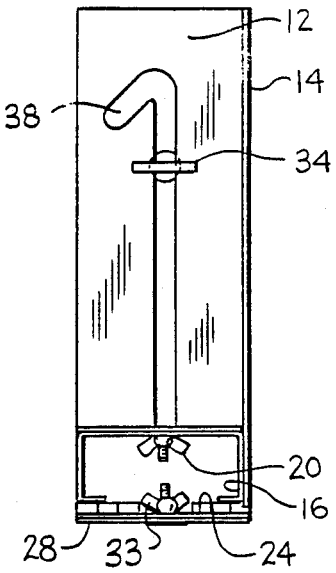
FIG. 2 is a front view looking at the position where the envelopes will be stacked.

Turning now to FIG. 2, an end view of the portable envelope feeder 10, there is seen vertical rectangular members 12 and 14 and rectangular base 16. It is noted that vertical rectangular member 12 has a slot 36 cut in the center of the vertical rectangular member such that weight 34 can slide down as the envelopes are used up. It is also noted that slot 36 has an offset slot 38 at the top of slot 36 where the weight 34 can be moved into the offset slot 38 when the envelopes are loaded into the portable envelope feeder. After the envelopes are loaded in the feeder, the weight 34 is placed on top of the stack to hold them in place while the portable envelope feeder members are tilted forward to start the printing process. FIG. 2 also shows thumb screws 20 and 33 along with second rectangular plate 24 and rectangular base plate 28. Weight 34 can be disassembled by threaded means (not shown) and removed. The weight 34 used can vary between 1 and 10 ounces depending on the weight of the envelopes being printed.

Figure 3:
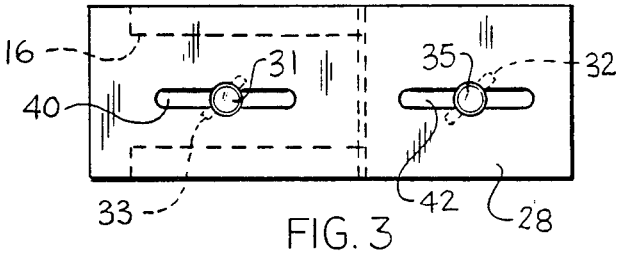
FIG. 3 is a bottom view showing the slots in the base plate to provide the adjustment for different size envelopes.

FIG. 3 show the portable envelope feeder 10 as seen from the bottom. rectangular base plate 28 contains two symmetrical slots 40 and 42 which are used to adjust the rectangular base plate 28 to accommodate various lengths of envelopes to be printed.

Figure 4:
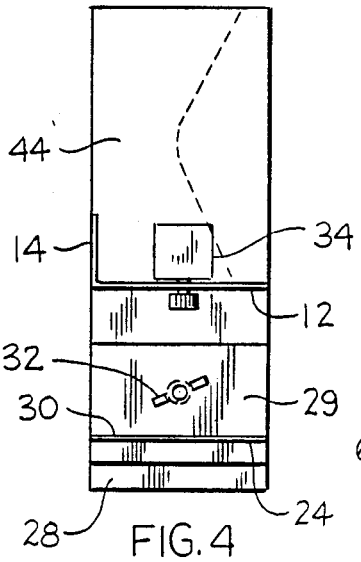
FIG. 4 is a top view showing the envelope posiTion for printing on the front or face side.

FIG. 4 shows a view looking at the top of the Portable envelope feeder 10 which shows wing nut 32, stop members 30 and 29 along with second rectangular plate 24 and rectangular base plate 28. The end of vertical rectangular members 12 and 14 are also seen in this view as is weight 34. FIG. 4 also shows the top of an envelope stack 44 that shows the envelope flap down and on the right side when standing in the back of the portable envelope feeder facing the offset printer. The envelope is in this position when it is desired to print on the front or face portion of the envelope.

Figure 5:
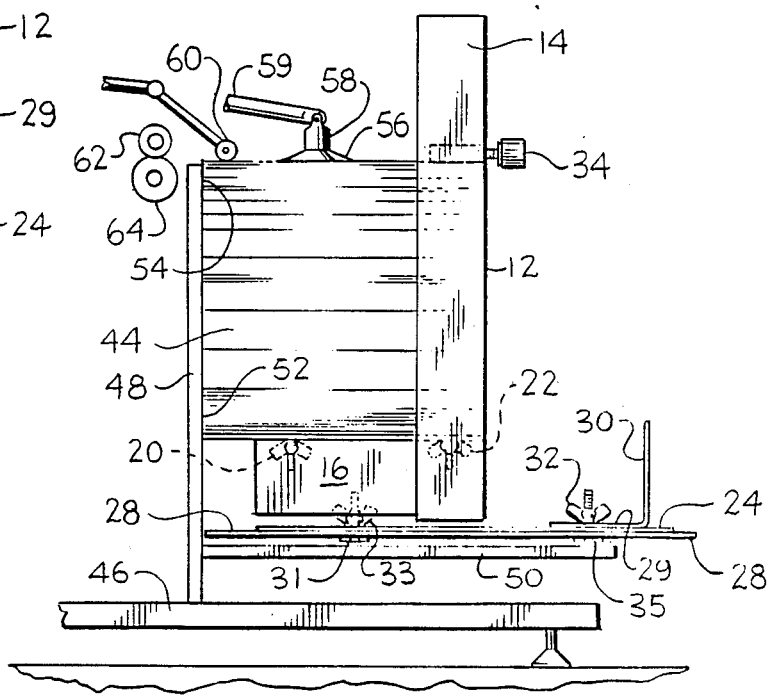
FIG. 5 shows the portable envelope feeder adjacent to an offset printer with envelopes stacked ready to be printed.
Figure 6:
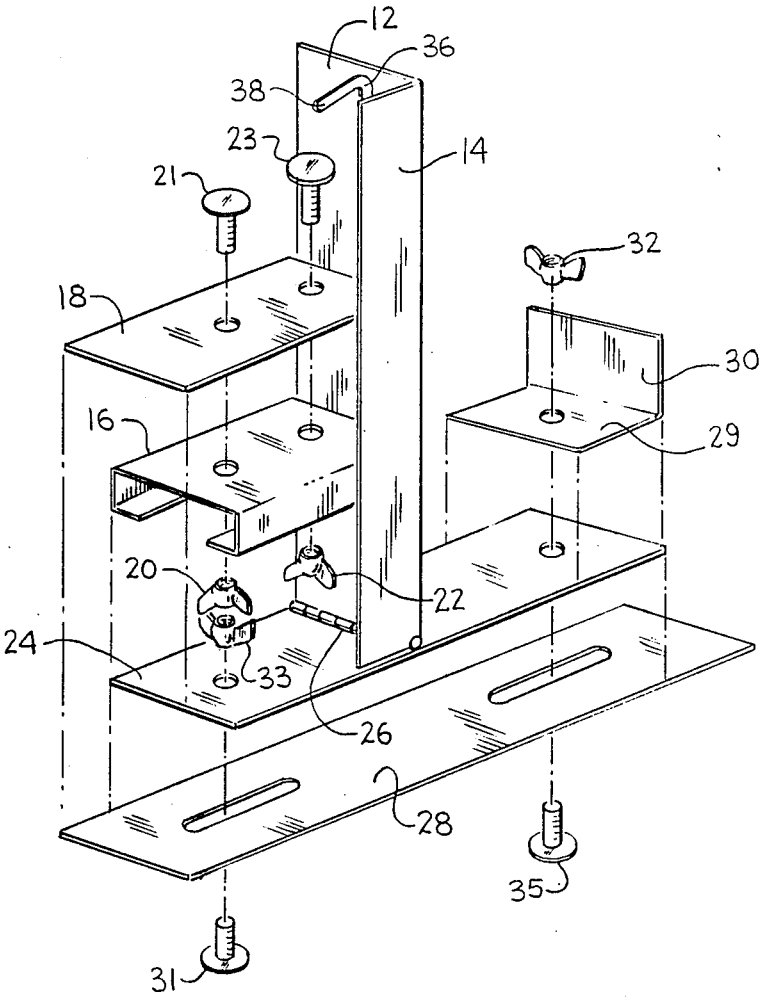
FIG. 6 is an "exploded" perspective view of the components of the portable envelope feeder.

Turning now to FIG. 5 there is seen a left side view of the portable envelope feeder 10 showing the feeder loaded with a stack of envelopes 44. In this view the portable envelope feeder is in position to communicate with an offset printer. The structure of the offset printer is given by a base 46, a vertical member 48 and an elevator member 50. The vertical member 48 may not be supported by base 46 on the offset printer and it is shown here for illustration purposes only. It is imperative, however, for the present invention to be utilized that there be a smooth flat vertical surface from 52 to 54 on vertical member 48 for the ends of envelopes 44 to engage. The ends of the envelopes 44 must be able to slide along the vertical surface from 52 to 54. The elevator member 50 is synchronized with the offset printer mechanism to move the envelope at the top of stack 44 to the offset printer gripping means which is a suction cup 56. The suction cup 56 which is sometimes called a "sucker foot" is attached to a sucker rod 58 and a translating bar 59 which contains an internal manifold (not shown) connected to a vacuum source. A height control bar 60 senses the top of the stack of envelopes and will activate the elevator member 50 to insure that the top envelope is in place before the sucker rod 58 and sucker foot 56 start the required movement to move the envelope such that the envelope end can be received by a drive roller 62 and feed roller 64. As can be seen in FIG. 5, the portable envelope feeder 10 is required to be fastened to the elevator member 50 by easily connected fastening means (not shown). Any type of spring clamp or screw clamp to temporarily hold the envelope feeder can be used.

The first rectangular plate 18 is available in the following lengths in inches, $6\frac{3}{4}$, 7, $7\frac{3}{4}$, 81□, $8\frac{7}{8}$, $9\frac{1}{2}$, $10\frac{3}{8}$11, and 11 $\frac{1}{2}$. however, only one length is shown in the drawings. !hese lengths of plate 18 will fit all the stock sizes of envelopes presently available, however, the plate length of rectangular plate 18 is not limited To the above lengths.

The operation of the portable envelope feeder 10 is very simple and easy. First one selects the size of first rectangular plate 18 to be used. Thumb screws 20 and 22 are removed and the selected plate is fastened to base 16 by thumb screws 20 and 22 and bolts 21 and 23. This sets the correct distance of vertical rectangular member 12 from structure 48 or the length of the envelopes. The rectangular base plate 28 is placed un the elevator member 50 such that the end of plate 28 touches the structure member 48. Thumb screws 32 and 33 are loosened and the base rectangular plate 28 is slid toward or away from structure 48 until the rectangular base plate 28 and first rectangular plate 18 simultaneously touch the structure member 48. The thumb screws 32 and 33 are tightened and the envelope feeder is fastened to elevator member 50. The translating bar 60 and sucker rod 58 are moved out of the way and the vertical rectangular members 12 and 14 are tilted back until member 12 rests on stop member 30. This position is shown as a dotted line in FIG. 1. The envelopes are loaded with one end resting against vertical member 12 with the flaps on the right side as viewed from the top in FIG. 4 if printing on the front of the envelope is desired. A maximum of 500 envelopes or any portion thereof can be loaded on the portable envelope feeder of the present invention. The vertical rectangular members 12 and 14 are then rotated such that rectangular first plate 18 and rectangular base plate 28 are again touching the structure 48. The translating bar 59 and sucker rod 58 are then put in place and the offset printer is ready to be operated. If the stack 44 is not in the proper place for the top envelope to be fed to the drive roller 62 and feed roller 64, the elevator member 50 will move up until the translating bar 60 senses the proper position of the top envelope of stack 44 and the sucker rod 58 will activate to move the envelopes to the feed roller 64 and drive roller 62 which will further move the envelopes into the offset press to be printed. This process is repeated and the elevator member 50 continues to move the envelope feeder up the proper amount until all the envelopes in stack 44 are printed. As previously stated, the structures 46, 48 and 50 of the offset printer are for illustration purposes only as the structure of a specific printer may be slightly different from that shown. The portable envelope feeder described herein can be used in conjunction with the following offset printers and models as presently known. However, it is noted, the use of the portable envelope feeder is not limited to these models

| Press Name | Model |
|---|---|
| HANANDA | 880 |
| HANANDA | 770 |
| HANANDA | 660 |
| HANANDA | 662 |
| CHIEF | 15 |
| CHIEF | 17 |
| MULTI | 1250 |
| MULTI | 1870 |
| MULTI | 2850 |
| RYOBI | 3200 |
| ITEK | 960 |
| HEIDELBERG | TOK |
| ZESTETNER | 311 |
| ZESTETNER | 312 |
| ZESTETNER | 313 |

As can be seen from the above list, a number of different makes and models of printer can use the present invention to print envelopes without having a dedicated printer for envelopes or having to send the envelopes to another print shop to have printed. The cost of the present invention is insignificant when compared to having a printer dedicated to printing envelopes.

Thus, it is apparent that there has been provided, in accordance with the invention, a portable envelope feeder that fully satisfies the objectives, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations that fall within the spirit and scope of the appended claims.

What is claimed is:

1. A portable feeder in combination with an offset printer, said feeder not being integral with said offset printer comprising:

a feed roller and a drive roller in said offset printer for receiving said envelopes, said drive roller cooperating with said feed roller;

at least one sucker rod attached to said offset printer having a suction cup mounted on the end of each rod and further having a manifold connecting to the sucker rod and hence the suction cup to a vacuum source, said sucker rod and said suction cup supplying said envelopes to said drive and feed rollers;

a translating bar connected to said scuker rods for conveying said envelopes, said translating bar being driven by said offset printer;

a height control bar that senses the height of said envelopes;

a platform synchronized with said offset printer mechanism that will move said envelopes upward in response to said height control bar as said envelopes are reduced by said envelopes being fed into said offset printer, said platform being perpendicular to a smooth vertical structure on said offset printer;

a sheet metal frame having a base, said base being a rectangular structure, having a first and second end, said structure being open on said first and second ends, said structure having a top piece, two side pieces and two bottom poieces connected to said two side pieces, said bottom pieces arranged to provide access to the bottom portion of said top piece, said top piece having two holes aligned to be on a centerline of said top piece and parallel to said side pieces;

first and second vertical rectangular members, each member having a top end and a bottom end, said first and second rectangular members being joined in a perpendicular relationship on one edge, the bottom ends of said first and second rectangular members being joined to one end of said base, said vertical rectangular members being perpendicular to said top piece of said base;

a first rectangular plate, having two holes therethrough, positioned on and a ligned with the holes in the top piece of said base, said first plate having fastening means to fasten said first plate to the top piece of said base, the longitudinal dimension of said first rectangular plate being selected to match the longitudinal dimension of an envelope;

a second rectangular palte, positioned below and aligned with said base, and said second pale being adjacent to said bottom piece of said base, said second plate having holes therethrough, said second plate having hinge means connecting said second plate and the bottom end of said second vertical rectangular member;

a rectangular base plate positioned below and aligned with said second plate, said base plate having symmetrical slots along a centerline of said base plate and parallel to said second plate, said base plate having fastening means that fasten said base plate to said second plate, said rectangular base plate being attached to said platform by tightening at least one screw type clamp such that said frame is in a position where said feeding of said envelopes is accomplished, said rectangular base plate being detached from said platfrm by loosening at least one screw type clamp such that said frame is removed from said offset printer;

a stop composed of a vertical member and a horizontal member, said horizontal member being adjacent to and aligned with said second plate, said vertical member being perpendicular to said horizontal member and joined at one edge of said horizontal and vertical member, said horizontal member having a hole therethrough and fastening means that fastens said stop to said base plate with said second plate there between;

a vertical slot in the center of said second vertical rectangular member, said vertical slot having an offset at the upper end of said slot, said slot further containing a slidable weight equal distributed on each side of said second vertical rectangular member for holding said envelopes, whereby said slidable weight on the envelope side provides friction on the end of said envelopes and on the side opposite the envelope side provides a counterbalance to offset the movement induced by an envelope being gripped by said sunction cups, said slidable weight being place din said offset at the upper end of said slot in said second vertical rectangualr member when said frame is void of said envelopes;

said frame being swingable between an operative upright position and a loaded tilted position, said frame in a loaded tilted position rests against said vertical rectangular member of said stop;

said slidable weight being removed from said offset and placed on said envelopes while said frame is in aloading tilted position, said envelopes having said flap of said envelopes in the down position when printing on the front of said envelopes, said envelope flap being opposite said first vertical rectangular member, said envelopes having said flaps of said envelope in an up position when printing on the back of said envelope, said envelope flap being opposite said first vertical rectangular member;

said rectangular plate abutting a smooth vertical structure on said offset printer;

said rectangular base plate being adjustable to abut said smooth vertical surface on said offset printer.

* * * * *